US005970680A

United States Patent [19]

Powers

[11] Patent Number: 5,970,680

[45] Date of Patent: Oct. 26, 1999

[54] AIR-LIFTED SLAB STRUCTURE

[76] Inventor: James M. Powers, 3 Santa Lucia Ave., Ormond Beach, Fla. 32174

[21] Appl. No.: 08/987,623

[22] Filed: Dec. 10, 1997

[51] Int. Cl.[6] ..... E04B 1/00; E04G 21/00; E04G 23/00

[52] U.S. Cl. ..... 52/745.05; 52/745.05; 52/745.2; 52/749.1; 52/126.5; 52/125.1

[58] Field of Search ..... 52/745.05, 745.2, 52/749.1, 126.5, 125.1

[56] References Cited

U.S. PATENT DOCUMENTS

| | | | |
|---|---|---|---|
| 2,686,420 | 8/1954 | Youtz . | |
| 2,715,013 | 8/1955 | Slick . | |
| 2,749,592 | 6/1956 | Vartia | 52/745.11 |
| 2,867,111 | 1/1959 | Youtz . | |
| 3,028,143 | 4/1962 | Cheskin . | |
| 3,382,627 | 5/1968 | Vartia | 52/125.1 |
| 4,006,567 | 2/1977 | Flannery | 52/64 |
| 4,301,630 | 11/1981 | Burklan . | |
| 5,644,893 | 7/1997 | Neighbo . | |

OTHER PUBLICATIONS

David Peraza; Progressive Architecture 1995 v76 n5 p. 104(6); Collapse at L;Ambiance: what went wrong?; Apr. 1995; 3pgs.

*Primary Examiner*—Carl D. Friedman
*Assistant Examiner*—Jennifer I. Thissell

[57] ABSTRACT

A method and apparatus for raising concrete floor slabs to form a multi-floor structure. Slabs are cast near ground level with apertures cast for well placed columns. The slabs are lifted sequentially, uppermost first, by an air cushion backed up by follower means to hold the slabs safely at any elevation reached. The air cushion is created between the current uppermost slab, the slab below, and the walls of a steel enclosure erected around the stacked slabs and extending upward allowing slabs to travel upward.

5 Claims, 4 Drawing Sheets

AIR-LIFTED SLAB STRUCTURE

BACKGROUND—FIELD OF INVENTION

This invention relates to an improved building construction method and apparatus for lifting of ground-level floor slabs to their final position in multi-story structures.

BACKGROUND—DESCRIPTION OF PRIOR ART

Multi-story structures have been constructed by several techniques using several types of material, e.g. structural steel, reinforced concrete either precast or in situ or any combination thereof. Most current lift-slab methods utilize one of a variety of lifting mechanisms anchored to pre-elevated columns that pass through apertures cast in a stack of slabs cast one on another at ground level (U.S. Pat. Nos. 2,686,420 and 2,867,111 to Phillip N. Youtz, 2,715,013 to Thomas B. Slick, and 3,028,143 to David B. Cheskin). Lifting is usually done by short hydraulic strokes converted to a long lift by some shoring mechanism to lift pre-formed slabs for attachment to these same pre-elevated columns. These processes usually require several week's elevation time for a several story building and are delicate unstable processes (Collapse at L'Ambiance: what went wrong? by David Peraza in Progressive Architecture 1995 v76 n5 p104(6) (April 1995)). Abstract:

"The collapse of Bridgeport, Conn.'s L'Ambiance Plaza, a 16-story building under construction in 1987, was the result of error, not the lift-slab technology used. Lift-slab's safety record since the mid-fifties has been unimpeachable. By casting concrete floors at ground level, falls by construction workers are actually minimized. Research has shown undersized steel-column shearheads to be the probable cause of L'Ambience's collapse".

See also, generally, U.S. Pat. No. 4,301,630 to Raymond A. Burkland and U.S. Pat. No. 5,644,893 to Gregory J. Neighbours.

SUMMARY

It will be seen that use of a surprisingly low pressure air cushion under the large surface area of a floor slab, leveled and backed up for safety by a follower means, permits rapid safe vertical handling of large heavy slabs within enclosures designed to confine the air cushion as the enclosure guides the slabs in their travel upward.

OBJECTS AND ADVANTAGES

Accordingly, several objects and advantages of my invention are:

A quicker, safer, fully enclosed lifting process.

The enclosure keeps all workmen outside the lifting area.

In the preferred embodiment, smooth continuous lifts, upon an air cushion, controlled by crane operators raise one slab after another to the final position without successively repositioning slabs.

The air cushion makes possible the lifting of far larger slabs than possible by crane alone.

A surprisingly low pressure air cushion, less than one p.s.i., lifts concrete slabs up to one foot thick.

The slabs, handled by an air cushion, are stressed far less.

The enclosure continuously holds the columns in position during the lift keeping the building plumb.

The period of erection is vastly accelerated to the point where slabs are affixed in final position greatly increasing construction safety.

Still further objects and advantages will become apparent from a consideration of the ensuing description and accompanying drawings.

REFERENCE NUMERALS

10 steel columns

12 tubular steel shear heads

14 slab

16 steel air cushion enclosure

Figure 1:
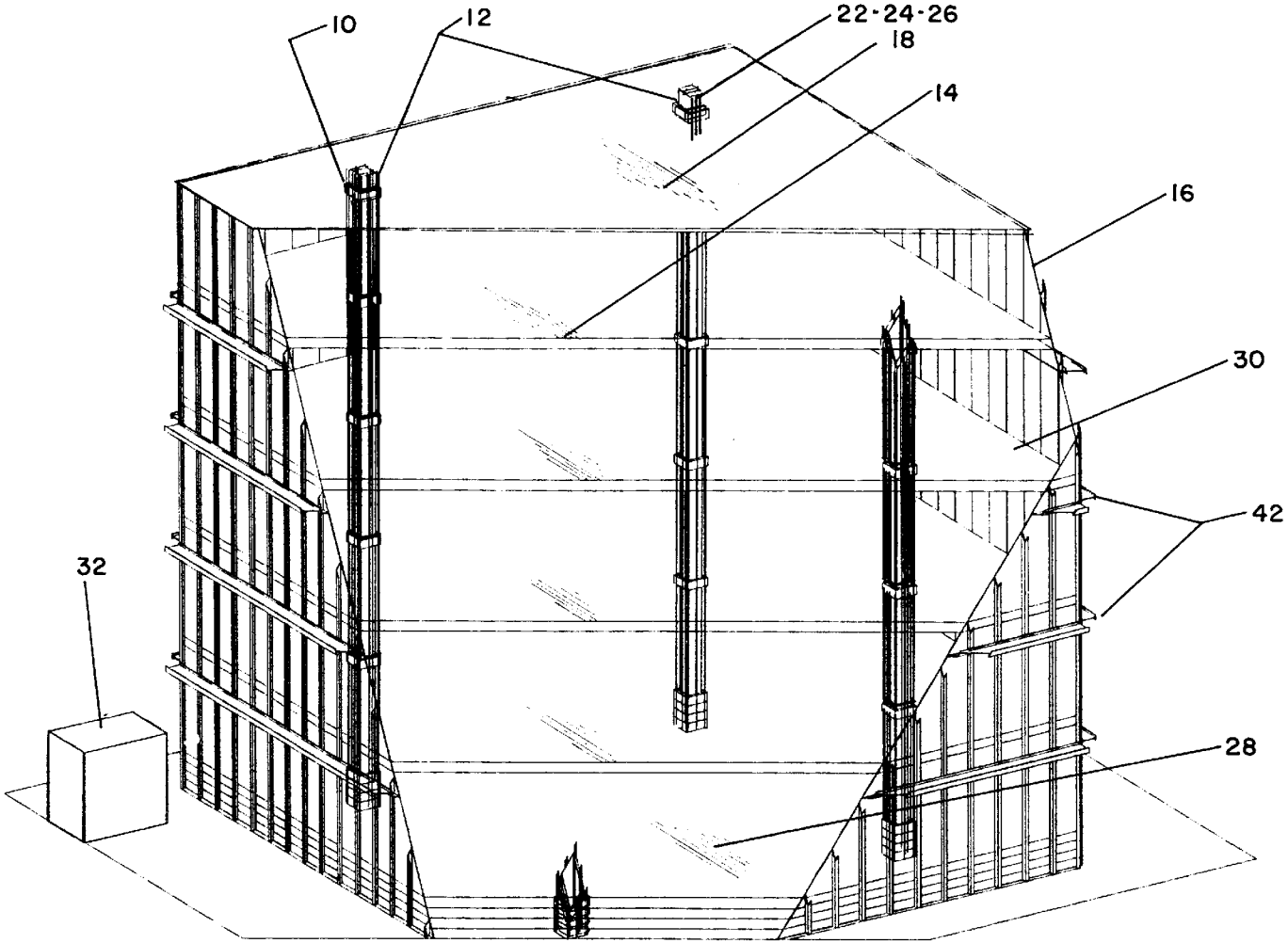
FIG. 1 is a three dimensional wire frame view of the air lifting enclosure erected around the stacked slabs and attached to and bracing the columns at the top.
Figure 2:
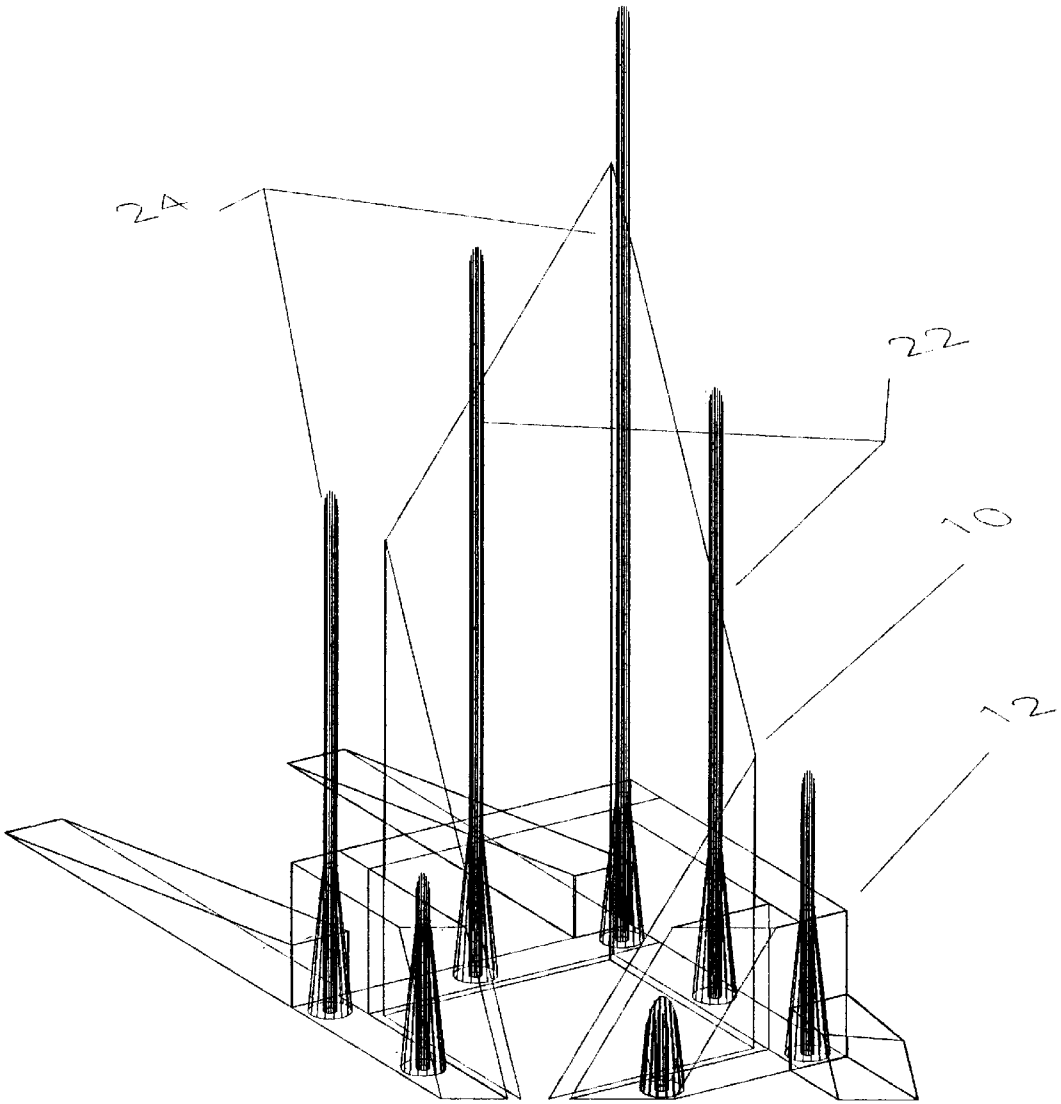
FIG. 2 is a view in detail of followers and crane-lifting cable at one column.
Figure 3:
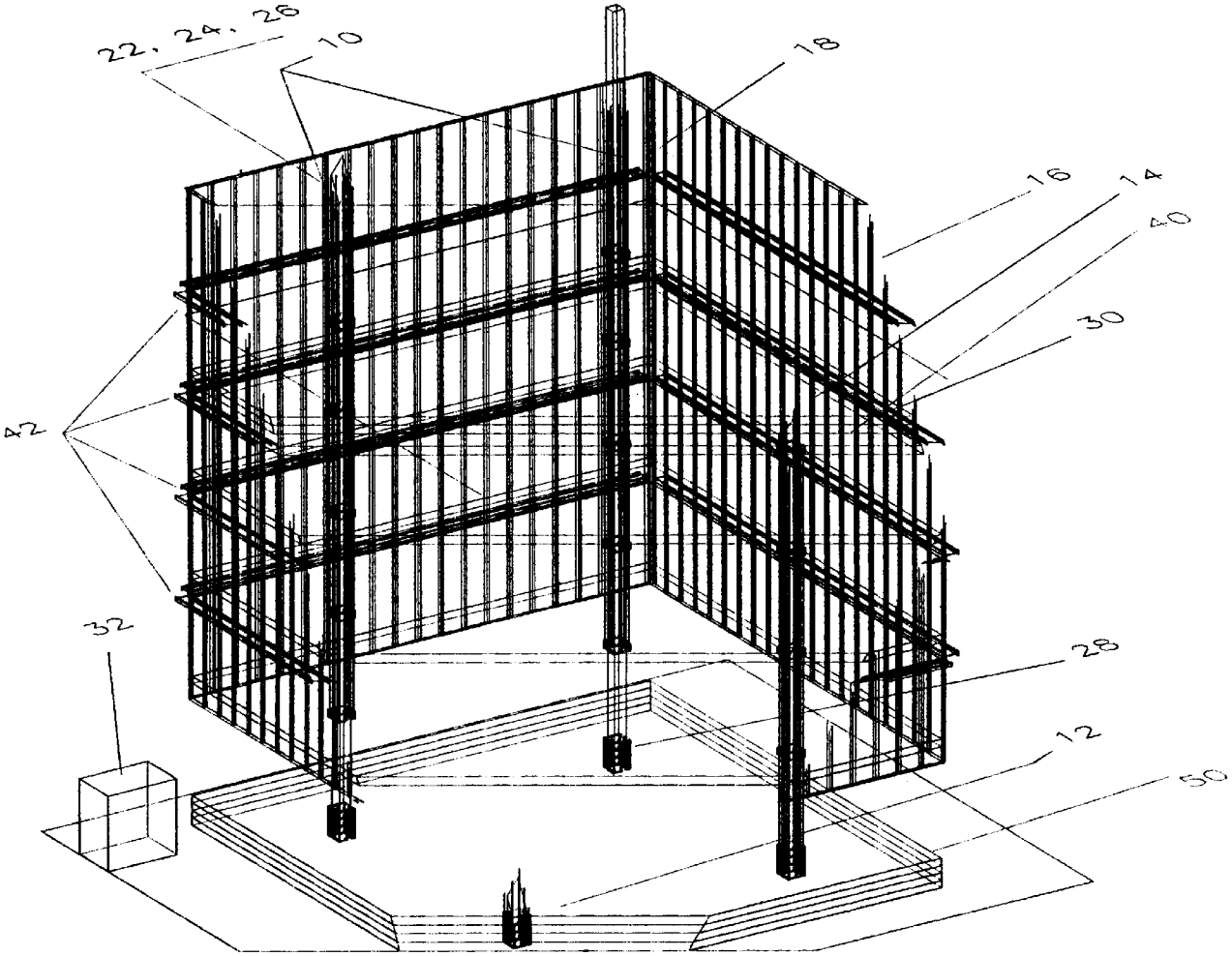
FIG. 3 is a lifted air cushion enclosure.
Figure 4:
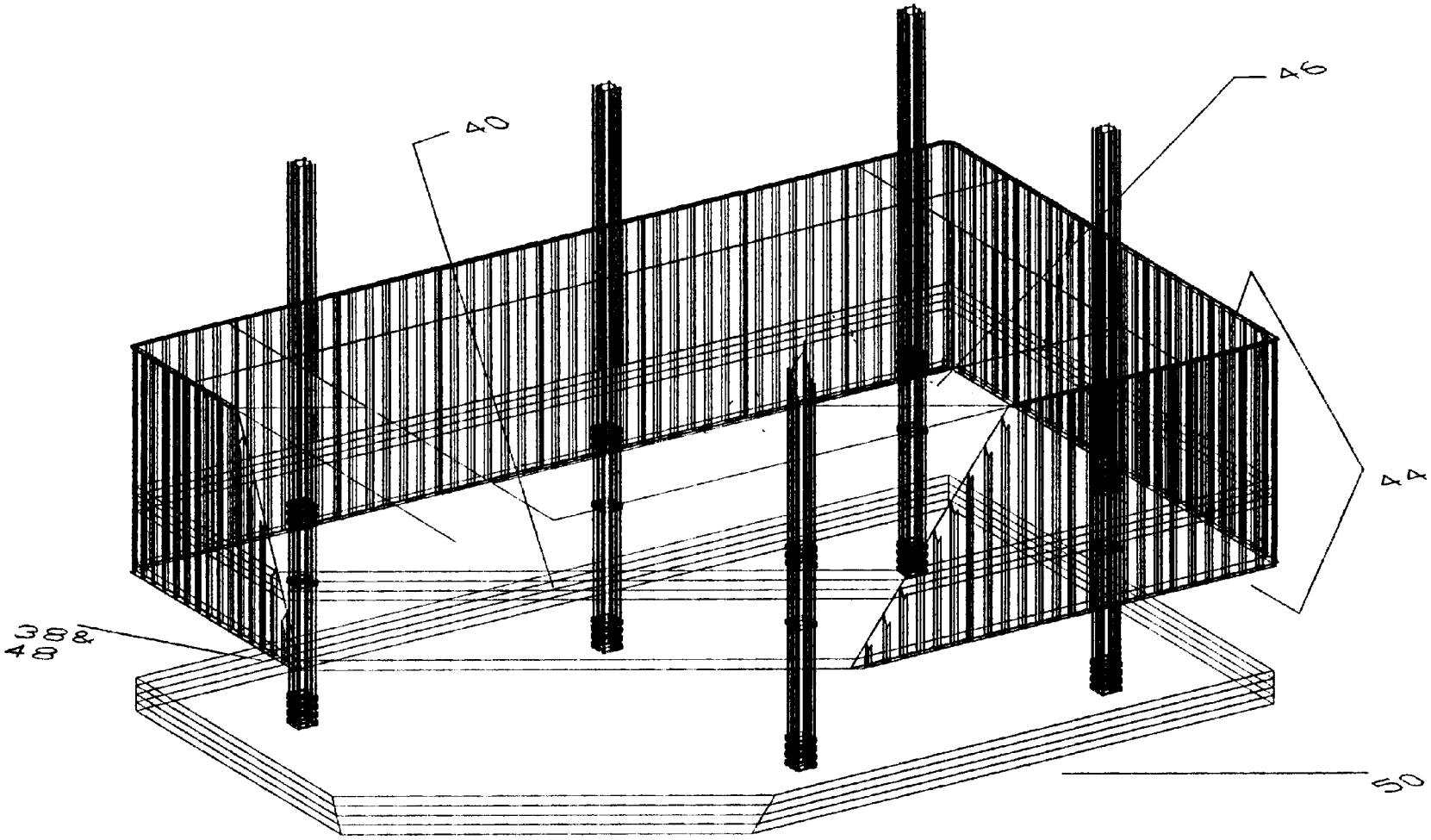
FIG. 4 is a modified enclosure for very large slabs.

18 enclosure connected supportively to column tops

20 follower wedge ratchets

22 follower cables

24 lifting cables

26 guides at column top

28 air cushion

30 seal

32 air compressor

38 enclosure lifted and base bolted to highest slab that has been fixed in its final destination

40 staging area

42 horizontal girders

44 stiffeners spanning vertically

46 tension belt

48 large enclosure lifted

50 slabs before lifting

PREFERRED EMBODIMENT—DESCRIPTION

A multi-story structure is built upon column foundations and ground slab by the following steps:

a) Erect steel columns 10 at specified points.

b) Install a stack of tubular steel "shear heads" 12 around each column, one to be embedded at each column in each slab 14 to allow later attachment of each slab to all columns at final slab elevation.

c) Form and pour each slab in turn, first upon ground slab then upon each succeeding slab till all floors are poured and cured embedding the shear heads stacked around each column. A parting film between slabs prevents adhesion.

d) Surround the stacked slabs with the steel air cushion enclosure 16 which extends to the top of the columns and is connected supportively to column tops 18 to keep the columns plumb and rigid.

e)* Follower wedge ratchets 20 are embedded in the shear head in each slab at each column. Said wedge ratchets used in this embodiment are borrowed from the split cone chucks in common use to seize and stretch concrete pre-stressing cables. Similar chucks used inverted for lifting and in pairs to translate short hydraulic strokes into a long lift were claimed in U.S. Pat. No. 2,715,013 (see Prior Art pg.1). The present invention uses them as in-slab cable climbers that act as follower ratchets. Follower cables 22 are passed through wedge ratchets in shear heads, anchored tautly in fixtures at top and bottom of each column, and stretched parallel to and positioned around corresponding columns. The followers prevent any retrograde motion once the slabs begin their climb.

f)* Lifting cables 24 are attached to each slab and passed where necessary through overlying slabs parallel to the follower cables and through guides at column top 26 to be accessed by crane.

g)* The cranes will lift less than one third of each slab weight one slab at a time but will maintain the slabs level during lift.

h) The remaining lift will be provided by an air cushion 28 created between the slab uppermost in the stack, the next lower slab, and the walls of the air cushion enclosure.

i) The air cushion will be maintained as the slab rises up through the confining walls of the enclosure by a seal 30 attached to slab edges and by air from a large air compressor 32 connected at the base of the enclosure.

j) Cranes lift lifting cables as air cushion assists while top slab is lifted to final position and air cushion is released. Remaining slabs are similarly lifted successively to their respective positions.

*e), f), & g) acting in concert in this embodiment describe a "follower means" described more generally in claims 1c) & 4c).

OTHER EMBODIMENTS

Lifted Air Cushion Enclosure for Tall Structures

For very tall structures the height of the air cushion enclosure becomes prohibitive. Slab lift is limited by the slab travel accommodated by the height of the enclosure. For tall structures a first lift is made of all upper slabs to a staging area at the top of the enclosure. The second floor slab and hopefully a subsequent slab or two can be located and fixed on their final sites at subsequent floors. The enclosure is then unbolted from the ground slab and relocated upward and bolted air tight at its base to a slab that has been fixed in its final destination 38. After bolting the lifted enclosure to the highest fixed slab the remainder of the slabs above this slab can be lifted either to intended floors or to another staging area 40. By stages slabs can be thus lifted to great heights.

Modified Enclosure for Very Large Slabs

For very large slabs the size of the air cushion enclosure becomes prohibitive. The horizontal girders 42 that confine the enclosure, belt the enclosure, and in the case of large slabs would have to be immense to confine air cushion pressure. Instead of horizontal belts of trusses about the enclosure to confine the air cushion, this embodiment proposes multiple parallel vertical stiffeners attached to enclosure exterior spanning vertically 44 from anchor points at the ground slab to anchors in a tension belt 46 capping the top of a shorter, two floor high, enclosure wall.

All slabs but the lowest, second floor slab are lifted to a staging area near the top of the enclosure. This enclosure can be lifted 48 and its base bolted to the lifted second floor slab. The remainder of the slabs can then be air cushion lifted to a staging area above the third floor. By one floor stages very large slabs can be lifted to great heights.

What is claimed is:

1. A method for constructing a multi-story building comprising the steps of:

a) providing, stacked upon on a ground slab, a plurality of equally sized and shaped floor slabs so that their perimeters are vertically registered together, b) providing at least one supporting column projecting up through vertically registered holes through each said floor slab, c) providing a follower means to hold slabs level while they are lifted and to hold them safely at any elevation reached at any moment during lift, d) providing an enclosure erected confiningly around the stacked slabs and extending upward to allow slabs to travel upward within but confined by said enclosure, e) providing a seal around edges of each slab slideably contacting the enclosure, f) providing a pressurized air cushion between the current uppermost stacked slab, the next slab below and the walls of the enclosure, g) increasing the pressure of said air cushion to lift said current uppermost stacked slab and, sequentially likewise, subsequent slabs to selected positions.

2. A method for constructing a multi-story building according to claim 1 wherein said at least one column top is connected supportively by structures across the top of enclosure to keep the column or columns plumb and rigid.

3. A method for constructing a multi-story building according to claim 1 wherein:

a) the air cushion lifts slabs to a staging area near the top of the enclosure, b) the enclosure itself is slid upward and its base is sealed air tight to one of the lifted slabs while still surrounding higher slabs in said staging area, c) the slabs in the staging area are then further air cushion lifted even higher still, successively and sequentially, from higher slab first to lower slab into selected positions, d) the enclosure and staged slab lifting is repeated within the limits dictated by column height.

4. An apparatus for raising heavy floor slabs comprising:

a) a smooth-interior enclosure erected around and shaped to match equally sized and shaped said floor slabs whose perimeters are vertically registered together with said enclosure extending upward to allow slabs to travel upward within but confined by the enclosure, b) at least one supporting column for projecting up through vertically registered holes through each floor slab, c) a follower means to hold slabs level while they are lifted and to hold them safely at any elevation reached at any moment during lift, d) a seal adapted around edges of each slab slideably contacting the enclosure, e) a high volume air compressor providing a pressurized air cushion between the current uppermost stacked slab, the next slab below and the walls of the enclosure, f) mean for increasing the pressure of said air compressor providing a pressurized air cushion to lift selected stacked slabs to selected positions.

5. An apparatus for raising heavy floor slabs according to claim 4 wherein said at least one column top is connected supportively by structures across the top of enclosure to keep the column or columns plumb and rigid.

* * * * *